United States Patent [19]

Wisotsky

[11] Patent Number: 4,557,846

[45] Date of Patent: Dec. 10, 1985

[54] LUBRICATING OIL COMPOSITIONS CONTAINING HYDROXAMIDE COMPOUNDS AS FRICTION REDUCERS

[75] Inventor: Max J. Wisotsky, Highland Park, N.J.

[73] Assignee: Exxon Research and Engineering Co., Florham Park, N.J.

[21] Appl. No.: 567,247

[22] Filed: Dec. 30, 1983

[51] Int. Cl.[4] ..... C10M 1/36

[52] U.S. Cl. ..... 252/51.5 A

[58] Field of Search ..... 252/51.5 A

[56] References Cited

U.S. PATENT DOCUMENTS

| | | | |
|---|---|---|---|
| 3,223,635 | 12/1965 | Dwyer et al. | 252/51.5 |
| 3,341,573 | 9/1967 | Shibe | 252/51.5 A |
| 3,647,694 | 3/1972 | Swanson et al. | 252/51.5 A |
| 3,676,344 | 7/1972 | Kuceski | 252/49.3 |
| 4,151,101 | 4/1979 | Anzenberger, Sr. et al. | 252/49.6 |
| 4,388,201 | 1/1983 | Brownawell et al. | 252/49.6 |

*Primary Examiner*—Jacqueline V. Howard

*Attorney, Agent, or Firm*—Eugene Zagarella; Edward H. Mazer

[57] ABSTRACT

A lubricating oil composition having improved friction reducing properties and the method of reducing friction in internal combustion engines by lubricating said engines with said lubricating oil which contains an effective friction reducing amount of a selected hydroxyamide compound.

17 Claims, No Drawings

LUBRICATING OIL COMPOSITIONS CONTAINING HYDROXAMIDE COMPOUNDS AS FRICTION REDUCERS

BACKGROUND OF THE INVENTION

This invention relates to a lubricating oil composition having improved friction reducing properties and to a method for reducing friction in internal combustion engines. More particularly, this invention is directed to a lubricating oil composition containing selected hydroxyamide compounds as friction reducing additives and to a method of reducing friction in an internal combustion engine by using a lubricating oil which contains said hydroxyamide compounds.

There has been considerable effort in recent years to improve the fuel economy of automotive engines which operate on petroleum fuel, a product which like other forms of energy has become relatively expensive. Some of the known ways to improve fuel economy has been of a mechanical or design nature, such as building smaller cars and engines. Since it is known that high engine friction causes significant energy loss, another way to improve fuel economy of automotive engines is to reduce such friction.

Major efforts to reduce friction in automotive engines have involved the lubricating oils used in such engines. One approach has been to use synthetic ester base oils which are generally expensive. Another approach has been to use additives to improve the friction properties of the lubricating oil. Among the friction reducing additives which have been used are a number of molybdenum compounds including insoluble molybdenum sulfides and several organo molybdenum complexes, e.g. molybdenum amine complexes disclosed in U.S. Pat. No. 4,164,473, molybdenum thio-bis-phenol complexes disclosed in U.S. Pat. Nos. 4,192,753, 4,201,683, and 4,248,720, molybdenum oxazoline complexes disclosed in U.S. Pat. No. 4,176,074 and molybdenum lactone oxazoline complexes disclosed in U.S. Pat. No. 4,176,073.

Another group of friction reducing additives which have been used in lubricating oils are the carboxylic acid esters. These compounds include the esters of fatty acid dimers and glycols as disclosed in U.S. Pat. No. 4,105,571, the esters of monocarboxylic acids and glycerol as disclosed in U.S. Pat. No. 4,304,678, the ester of dimer acids and monohydric alcohol disclosed in U.S. Pat. No. 4,167,486, the esters of glycerol and monocarboxylic fatty acids as disclosed in U.K. Pat. Nos. 2,038,355 and 2,038,356, and esters of monocarboxylic fatty acids and polyhydric alcohols disclosed in U.S. Pat. No. 3,933,659.

Other friction reducing additives employed in lubricating compositions include nitrogen-containing products of phosphosulfurized esters disclosed in U.S. Pat. No. 4,298,484 and boric acid salts or borate esters of hydroxyalkyl imidazolines shown in U.S. Pat. No. 4,298,486.

While the different approaches and additives all generally provide some reduced engine friction and consequently improved fuel economy, there is still the need for additional additives and compositions which provide the necessary and desired friction reduction, and are also economical, readily available, and most important, are compatible with commonly used lubricating base oils and the many conventional additives used in lubricating oil compositions.

SUMMARY OF THE INVENTION

Now it has been found that lubricating oil compositions containing selected hydroxyamine compounds as an additive have improved friction reducing properties.

More particularly, this invention is directed to a lubricating oil composition having improved friction reducing properties comprising a major amount of lubricating base oil and from about 0.01 to about 2.0 percent by weight of a hydroxyamide compound having the formula:

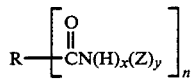

where R is the hydrocarbon radical or skeleton of a dimer carboxylic acid having a total of about 24 to about 90 carbon atoms with about 9 to about 42 carbon atoms between carboxylic acid groups; Z is (a) a hydroxy substituted alkyl group having about 1 to about 20 carbon atoms or (b) an oxyalkylene group of the formula:

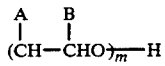

where A and B are each alkyl of 1 to 2 carbon atoms or hydrogen and m is an integer of 1 to 50; x is 0 or 1; y is 1 or 2 and n is 1 or 2.

Another embodiment of this invention relates to a method of reducing friction in an internal combustion engine by lubricating said engine using a lubricating oil composition which contains an effective friction reducing amount of the selected hydroxyamide compound as described herein.

DETAIILED DESCRIPTION OF THE INVENTION

This invention is directed to a lubricating oil composition containing a selected hydroxyamide compound additive to provide improved friction reducing properties and to a method of reducing friction in an internal combustion engine by using a lubricating oil composition which contains said selected hydroxyamide compound additive.

The friction reducing additive which is used in this invention is an oil soluble hydroxyamide compound having the formula:

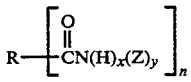

(I)

where R is the hydrocarbon radical, backbone or skeleton of a dimer carboxylic acid, Z is a hydroxy substituted alkyl group or an oxyalkylene group, and x, y and n are integers as hereinafter defined.

The dimer carboxylic acid used in preparing the hydroxyamide compound of this invention will be a dimer of an aliphatic saturated or unsaturated carboxylic acid, said dimer acid having a total of about 24 to about 90 carbon atoms, and from about 9 to about 42 carbon atoms between the carboxylic acid groups. Preferably, the dimer acid will have a total of about 24 to about 60 carbon atoms and about 12 to about 42 carbon atoms between the carboxylic acid groups, and more preferably, a total of about 24 to about 44 carbon atoms and about 16 to about 22 carbon atoms between the carboxylic acid groups. The dimer acid hydrocarbon residue or skeleton group as shown in the hydroxyamide compound (I) may have one free carboxyl group, i.e., it may not be completely amidated.

The Z group as found in the hydroxyamide compound (I) may be (a) a hydroxy substituted alkyl group having about 1 to about 20, preferably 1 to 10, and more preferably 2 to 6 carbon atoms; or (b) an oxyalkylene group of the formula:

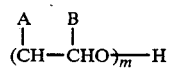

where A and B are each alkyl groups of 1 to 2 carbon atoms or hydrogen and m is an integer of 1 to 50. Preferably, in the oxyalkylene group A and/or B will be hydrogen and m will be 1 to 40. The preferred Z group in the hydroxyamide compound (I) is the hydroxy substituted alkyl group. In said hydroxy substituted alkyl group there may be more than one hydroxy group and more particularly 1 to 4 hydroxy groups with 1 to 2 being preferred and more preferably 1 hydroxy group being present.

In the hydroxyamide compound (I) shown above, x, y, and n are integers with x being 0 or 1, y being 1 or 2 and n being 1 or 2. Preferably x is 0, y is 2, and n is 2.

The hydroxyamide compounds of this invention are generally obtained by condensing a hydroxyamine such as an alkanolamine with an acid at elevated temperature. They also may be obtained by the reaction of the dimer acid amide with an oxyalkylene compound. Further description of the preparation of the hydroxyamides may be found in Kirk-Othmer, "Encyclopedia of Chemical Technology," Second Edition, Vol. 2, 1963, pp. 66–76.

The dimer carboxylic acids used in preparing the hydroxyamides of this invention and described of above are well known, commercially available compounds. Further details about such compounds may be found in U.S. Pat. Nos. 3,189,832; 3,429,817; 3,223,635; 4,105,571 and 4,388,201. In referring to dimer acids in this application, it is to be appreciated that reactions for producing such acids, particularly in commercial operations will generally lead to trimer and even tetramer formation and in some cases the product obtained will contain minor amounts of unreacted monomer or monomers. As a result, commercially available dimer acids may contain other products including as much as 25% trimer. The use of mixtures is within the scope of the present invention and intended to be covered by the term "dimer acid" as used herein.

The hydroxyamine compounds used in preparing the hydroxyamides of this invention are also known and commercially available and generally are named as alkanolamines or aminoalcohols. The hydroxyalkyl amines as described above can be considered derivatives of ammonia where at least one hydrogen is replaced by a hydroxyalkyl radical. One commercial method of preparation involves the reaction of ethylene oxide or propylene oxide with ammonia. The oxyalkylated amines may be formed as above, but also the oxyalkylated amines may be formed more directly from the reaction of a dimer acid amide, i.e., DA-$CONH_2$ where DA is the dimer acid backbone, with an oxyalkylene compound such as ethylene or propylene oxide. Further description of the preparation of the hydroxyamine compounds of the type used in this invention may be found in Kirk-Othmer, "Encyclopedia of Chemical Technology," Second Edition, Vol. 1, 1963, pp. 809–831 and Vol. 2, 1963, pp. 72–73. Typical compounds of this type include ethanolamine, diethanolamine, propanolamine, and 3-amino-1, 1-propanediol.

In preparing the hydroxyamide compounds used in this invention, generally one or more moles of hydroxyamine per mole of dimer acid is used depending on the degree of amidation of the dimer carboxyl groups that is desired. More particularly, from about 1:1 to about 3:1 moles of hydroxyamine per mole of dimer acid is used with about 1:1 to about 2:1 being preferred.

The hydroxamide friction reducing additives of this invention will generally be used at a concentration of from about 0.01 to about 2.0 percent by weight, preferably from about 0.01 to about 1.0 and more preferably from about 0.05 to about 0.5 percent by weight based on the total weight of the lubricating oil composition.

The lubricating base oil will generally comprise a major amount of the lubricating composition, i.e., at least 50% by weight thereof, and will include liquid hydrocarbons such as the mineral lubricating oils and the synthetic lubricating oils and mixtures thereof. The synthetic oils which can be used include diester oils such as di(2-ethylhexyl) sebacate, azelate and adipate; complex ester oils such as those formed from dicarboxylic acids, glycols and either monobasic acids or monohydric alcohols; silicone oils; sulfide esters; organic carbonates; and other synthetic oils known to the art. Mineral oils are the preferred lubricating base.

Other additives, known in the art, may be added to the oil composition of the present invention to form a finished oil. Such additives include dispersants, antiwear agents, antioxidants, corrosion inhibitors, detergents, pour point depressants, extreme pressure additives, viscosity index improvers, etc. These additives are typically disclosed for example in "Lubricant Additives" by C. V. Snmalheer and R. Kennedy Smith, 1967, pp. 1–11 and in U.S. Pat. No. 4,105,571.

The following examples are further illustrative of this invention and are not intended to be construed as limitations thereof.

EXAMPLE 1

A 10W40SE quality automotive engine oil was prepared containing a base oil comprising about 56 parts by weight of solvent 150 neutral and about 19 parts by weight of solvent 100 neutral mineral oil. It also contained 0.1 weight percent of a hydroxyamide compound friction reducing additive prepared by reacting a dimer acid comprising linoleic and/or oleic acid (sold commercially by Emery Industries, Inc., as Empol 1010) and ethanolamine. The composition additionally contained other additives conventionally used in automotive engine oils including a zinc dialkyl dithiophosphate antioxidant/antiwear agent, a rust inhibitor, i.e., overbased magnesium sulfonate, a detergent, and a V.I. improver, i.e., an ethylene-propylene copolymer.

The prepared composition was tested for coefficient of friction using a ball on cylinder test described in the "Journal of the American Society of Lubrication Engineers" (ASLE Transaction), Vol. 4, pages 1–11, 1961.

In essence, the apparatus consists basically of a fixed metal ball loaded against a rotating cylinder. The weight on the ball and the rotation of the cylinder can be varied during any given test or from test to test. Also, the time of any given test can be varied. Generally, however, steel on steel is used at a constant load, constant rpm and a fixed time and in each test of these examples, a 4 kg load, 0.26 rpm and 70 minutes was used. The apparatus and method used is more fully described in U.S. Pat. No. 3,129,580.

The prepared composition containing the hydroxyamide additive gave a coefficient of friction of 0.10. The same formulation without the additive has a significantly higher friction of 0.28.

EXAMPLE 2

Another automotive engine oil the same as described in Example 1 but having a different friction reducing additive, i.e., 0.1 weight percent of a hydroxyamide prepared by reacting a dimer acid (as in Example 1) with diethanolamine, was tested for coefficient of friction as in Example 1.

The resulting coefficient of friction was 0.11. As in the previous example, this composition containing the select hydroxyamide friction reducing additive in accordance with this invention, showed significantly reduced coefficient of friction as compared to the same formulation without the additive.

What is claimed is:

1. A lubricating oil composition having improved friction reducing properties comprising a major amount of lubricating base oil and from about 0.01 to about 2.0 percent by weight of a hydroxyamide compound having the formula:

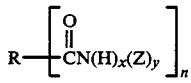

where R is the hydrocarbon radical of dimer carboxylic acid having a total of about 24 to about 90 carbon atoms with about 9 to about 42 carbon atoms between carboxylic acid groups and Z is (a) a hydroxy substituted alkyl group having about 1 to about 20 carbon atoms or (b) an oxyalkylene group of the formula:

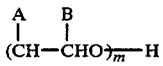

where A and B are each alkyl of 1 to 2 carbon atoms or hydrogen and m is an integer of 1 to 50; x is 0 or 1; y is 1 or 2 and n is 2.

2. The composition of claim 1 wherein said dimer acid has a total of about 24 to about 60 carbon atoms and about 12 to about 42 carbon atoms between the carboxylic acid groups and said hydroxy substituted alkyl group has about 1 to about 4 hydroxy groups.

3. The composition of claim 2 wherein said hydroxy substituted alkyl group has about 1 to about 10 carbon atoms.

4. The composition of claim 3 wherein in said oxyalkylene group, A and/or B are hydrogen, and m is 1 to 40.

5. The composition of claim 4 wherein about 0.01 to about 1.0 percent by weight of said hydroxyamide compound is used.

6. The composition of claim 5 wherein said dimer acid has a total of about 24 to about 44 carbon atoms and about 16 to about 22 carbon atoms between the carboxylic acid groups and said Z group in said hydroxyamide compound is a hydroxy substituted alkyl group.

7. The composition of claim 6 wherein said hydroxy substituted alkyl group has 1 to 2 hydroxy groups and 2 to 6 carbon atoms.

8. The composition of claim 7 wherein from about 0.05 to about 0.5 weight percent of said hydroxyamide compound is used.

9. The composition of claim 8 wherein the hydroxyamide compound is prepared from the combination of a dimer acid selected from the group consisting of linoleic acid, oleic acid and mixtures thereof, and a hydroxyamine compound selected from the group consisting of ethanolamine and diethanolamine.

10. A method of reducing friction in an internal combustion engine comprising lubricating said engine using a lubricating oil composition containing an effective friction reducing amount of an additive which is a hydroxyamide compound having the formula:

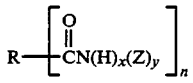

where R is the hydrocarbon radical of dimer carboxylic acid having a total of about 24 to about 90 carbon atoms with about 9 to about 42 carbon atoms between carboxylic acid groups, Z is (a) a hydroxy substituted alkyl group having about 1 to about 20 carbon atoms, or (b) an oxyalkylene group of the formula:

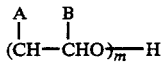

where A and B are each alkyl of 1 to 2 carbon atoms or hydrogen and m is an integer of 1 to 50; x is 0 or 1, y is 1 or 2, and n is 2.

11. The method of claim 10 wherein said composition contains about 0.01 to about 2.0 percent by weight of said hydroxyamide compound.

12. The method of claim 11 wherein said dimer acid has a total of about 24 to about 60 carbon atoms and about 12 to about 42 carbon atoms between the carboxcylic acid groups and said substituted hydroxyalkyl group has about 1 to about 4 hydroxy groups.

13. The method of claim 12 wherein said hydroxy substituted alkyl group has about 1 to about 10 carbon atoms and said composition contains about 0.01 to about 1.0 percent by weight of said hydroxyamide compound.

14. The method of claim 13 wherein in said oxyalkylene group, A and/or B are hydrogen, and m is 1 to 40.

15. The method of claim 14 wherein said dimer acid has a total of about 24 to about 44 carbon atoms and about 16 to about 22 carbon atoms between the carboxylic acid groups and said Z group in said hydroxyamide compound is a hydroxy substituted alkyl group.

16. The method of claim 15 wherein said hydroxy substituted alkyl group has 1 to 2 hydroxy groups and 2 to 6 carbon atoms.

17. The method of claim 16 wherein said composition contains about 0.05 to about 0.5 weight percent of said hydroxyamide compound.

* * * * *